United States Patent [19]

Kanai

[11] Patent Number: 5,074,057

[45] Date of Patent: Dec. 24, 1991

[54] DRYING APPARATUS HAVING A VERTICAL ROTARY SPIRAL BLADE

[76] Inventor: Masao Kanai, 1 8-10, Naga tasannoudai, Minami-ku yokohama, Japan

[21] Appl. No.: 547,848

[22] Filed: Jul. 3, 1990

[30] Foreign Application Priority Data

Jul. 5, 1989 [JP] Japan ..... 1-79430

[51] Int. Cl.[5] ..... F26B 11/12

[52] U.S. Cl. ..... 34/179; 34/147; 34/166

[58] Field of Search ..... 34/147, 179, 166

[56] References Cited

U.S. PATENT DOCUMENTS

| | | | |
|---|---|---|---|
| 4,245,399 | 1/1981 | Muller et al. | 34/166 |
| 4,499,669 | 2/1985 | Haeck | 34/166 X |
| 4,915,506 | 4/1990 | Sato et al. | 34/179 X |

*Primary Examiner*—Edward G. Favors

*Attorney, Agent, or Firm*—Cushman, Darby & Cushman

[57] ABSTRACT

Disclosed is a drying apparatus using a rotary spiral blade to put wet substance as bean-curd refuse into vigorous circulation in the vessel of the drying apparatus, thereby bringing the substance into contact with the heat conduction surface of the drying apparatus at an increased efficiency. The vessel has a steam jacket surrounding therearound for heating the inner wall of the vessel, thereby providing heat conduction surface thereon. The blade may be heated by steam, providing extra heat conduction surface.

5 Claims, 5 Drawing Sheets

DRYING APPARATUS HAVING A VERTICAL ROTARY SPIRAL BLADE

BACKGROUND OF THE INVENTION

1. Field of the Invention

The present invention relates to a drying apparatus for removing water content from liquid, semisolid or solid substance to be dried. Such drying apparatus comprises a drying vessel whose inner wall provides a heat conduction surface for transmitting heat to wet substance, and circulating rotary means to put the substance in motion in the vessel, thereby increasing the efficiency with which the substance can be brought to the heat conduction surface.

2. Description of the Prior Art

A drying apparatus is used for removing water content from liquid, semisolid or solid substance, such as cornstarch, beancurd refuse or water-and-powder mixture. Substances to be dried range from liquid or slurry substance or semi-solid to wet solid or powder-like substance. Such drying apparatus has a drying vessel to be loaded with substance to be dried. The drying vessel has heating means and a heat conduction surface for transmitting heat to the substance to be dried. Usually, such heating means uses steam which is supplied from a boiler. In an attempt to increase the amount of water vaporization per unit time the efficiency with which the substance is brought in contact with the heat conduction surface of the drying vessel is increased by putting the substance in motion relative to the heat conduction surface of the vessel. A conventional drying apparatus uses a circulator which has rotary paddles fixed to a rotary axle extending horizontally with respect to the direction of gravity. Its drying vessel has a jacket to be supplied with steam for heating the inner wall of the vessel, thereby permitting it to function as a heat conduction surface. In operation the paddles are rotated to bring the substance into contact with the inner wall of the vessel, which is heated and functions as heat conduction surface.

Another conventional drying apparatus uses a circulator which has disks fixed to a rotary axle extending horizontally with respect to the direction of gravity. Its drying vessel has a jacket to be supplied with steam for heating the inner wall of the vessel, and each disk has an inner hollow space to be supplied with steam for heating its surface, thereby permitting the disk surface to function as a heat conduction surface, too. In operation the substance is brought into contact with the heated inner wall of the vessel and the heated surface of each disk, both functioning as heat conduction surface.

These drying apparatuses are satisfactory in operation, but they have still disadvantages as follows. As for the drying apparatus using rotary paddles the paddles must be rotated against the resistance which is caused by the substance in the vessel, and therefore the paddles cannot be rotated at an increased speed. There is a fear of breaking the paddles if the rotation of paddles per unit time is increased in the hope of increasing the dewatering efficiency of the drying apparatus. A certain substance is liable to attach to the paddles when they rotate at an increased speed. Then, the substance is rotated along with the rotating paddles, and therefore it cannot be put in flowing motion on the heat conduction surface. This tendency increases with increased viscosity. For these reasons the paddles cannot be rotated at such an increased speed that the substance may be brought in contact with the heat conduction surface at an increased efficiency.

As for the drying apparatus using heating disks the dewatering efficiency can be increased by increasing the number of the heating disks. This will increase the total weight of the disks to be supported by a rotary axle, which extends horizontally relative to the direction of gravity. The axle must be stout, and accordingly its weight increases. As a consequence it is difficult to increase the rotation per unit time of the rotary axle and associated heating disks. This will limit the drying apparatus to a reduced dewatering efficiency. If the rotating speed of the heating disks is increased, the power of the driving motor must be increased. Disadvantageously the use of an increased power drive will cost much.

Summary of the Invention: One object of the present invention is to provide a drying apparatus which is capable of circulating wet substance at an increased speed and bringing the substance into contact with the heat conduction surface of the drying apparatus at an increased efficiency, thereby improving the dewatering efficiency of the drying apparatus.

To attain this object a drying apparatus for removing water content from liquid, semisolid or solid substance to be dried comprising: a drying vessel to contain said substance, said vessel having a heat conduction surface on its inner wall for transmitting heat to said substance: and circulating rotary means to put said substance in motion in said vessel, thereby increasing the efficiency with which said substance can be brought to said heat conduction surface, is improved according to the present invention in that said circulating rotary means comprises a rotary shaft vertically extending in said vessel in the direction of gravity, and a spiral blade integrally connected to and wound around said rotary shaft, said spiral blade having a flat upper surface, whereby rotation of said rotary shaft and hence said spiral blade may cause said substance to rise up in the direction of gravity, and slide on said flat upper surface of said spiral blade until the so raised substance is allowed to fall down in the direction of gravity through a falling space which is defined in said drying vessel, and until said substance has come in contact with said heat conduction surface.

Said drying vessel may be a hollow cylinder which is coaxial with said rotary shaft; the inner surface of said hollow cylinder may provide said heat conduction surface; and said spiral blade may be located close to said inner surface of said hollow cylinder but leaving a gap large enough to allow said spiral blade to rotate, thereby permitting said spiral blade to rotate and raise said substance while keeping said substance in contact with said heat conduction surface.

In operation wet substance is put in the drying vessel, and then the substance is located at a lower position under the influence of gravity. The heat conduction surface of the drying vessel is heated by heating means so that heat is transfered to the wet substance in the drying vessel. The spiral blade is made to rotate by rotating its axle. In case where the spiral blade is hollow and where heating medium is led into the inside of the spiral blade, the upper surface of the spiral blade will function as heat conduction surface like the inner wall of the drying vessel.

The wet substance layed on the upper surface of the spiral blade will slide thereon while the spiral blade rotates. Thus, the wet substance will be renewed to come to contact with the heat conduction surface of the drying vessel at an increased efficiency. The rotation of the spiral blade will cause the substance on the blade surface to rise up in the direction of gravity. When the substance is raised at a higher level, it will fall down in the direction of gravity through the falling space in the drying vessel. Thus, the substance rises and falls repeatedly in the drying vessel. The substance on the rotating spiral blade will slide along the blade surface because of inertia. The increase of the blade rotation will increase the slide speed of the substance on the blade surface.

The rotation of the spiral blade will raise the substance. Therefore, the increase of the rotation per unit time of the spiral blade will expedite the circulating motion of the substance in the drying vessel, bringing the substance into contact with the heat conduction surface both of the upper surface of the blade and the inner wall of the drying vessel. Accordingly the dewatering efficiency will be increased.

Specifically, when the spiral blade is rotated, the substance will be rotated because of friction between the substance and the blade surface, and will be raised. The centrifugal force will be applied to the substance on the spiral blade, thereby pushing the substance outwards until it has come to contact with the inner wall of the drying vessel. Thus, the substance will be made to rise and fall while being brought into contact with the heat conduction surface both of the spiral blade the inner wall of the drying vessel all the time.

Other objects and advantages of the present invention will be understood from the following description of a drying apparatus according to one embodiment of the present invention, which is shown in accompanying drawings.

Figure 1:
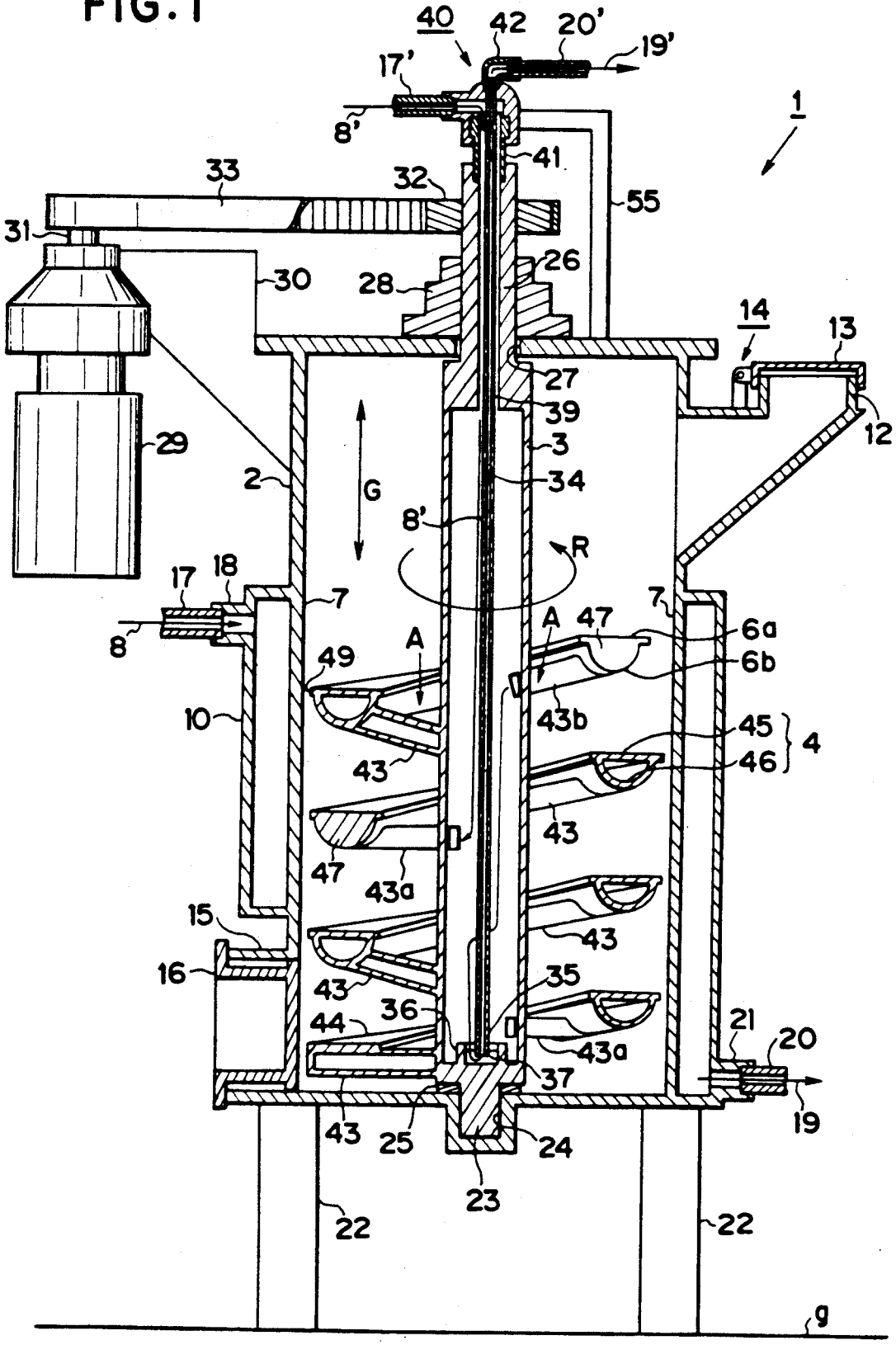
FIG. 1 is a longitudinal section of the drying apparatus.

As seen from the drawings, a drying apparatus 1 has a cylindrical drying vessel 2. It has a jacket 10 surrounding its outer wall. When steam 8 is supplied from an associated boiler 11 to the jacket 10, the vessel 2 will be heated to provide heat conduction surface 7 on its inner wall for transmitting heat to wet substance 5 in the vessel 2. The jacket 10 has a steam inlet 18 at its upper portion and a drain 21 at its lower portion. The steam inlet 18 is connected to the boiler 11 via a conduit 17. The drain 21 is connected to a conduit 20 for drawing off water when steam is condensed. The drying vessel 2 has an inlet 12 at its top for throwing wet substance 5 in the vessel 2. The inlet 12 has a closure 13 hinged to the vessel body as indicated at 14. The drying vessel 2 has an outlet 15 in the vicinity of the bottom for discharging dried substance. An reentrant cap 16 is inserted in the outlet 15 to close the outlet opening.

Figure 5:
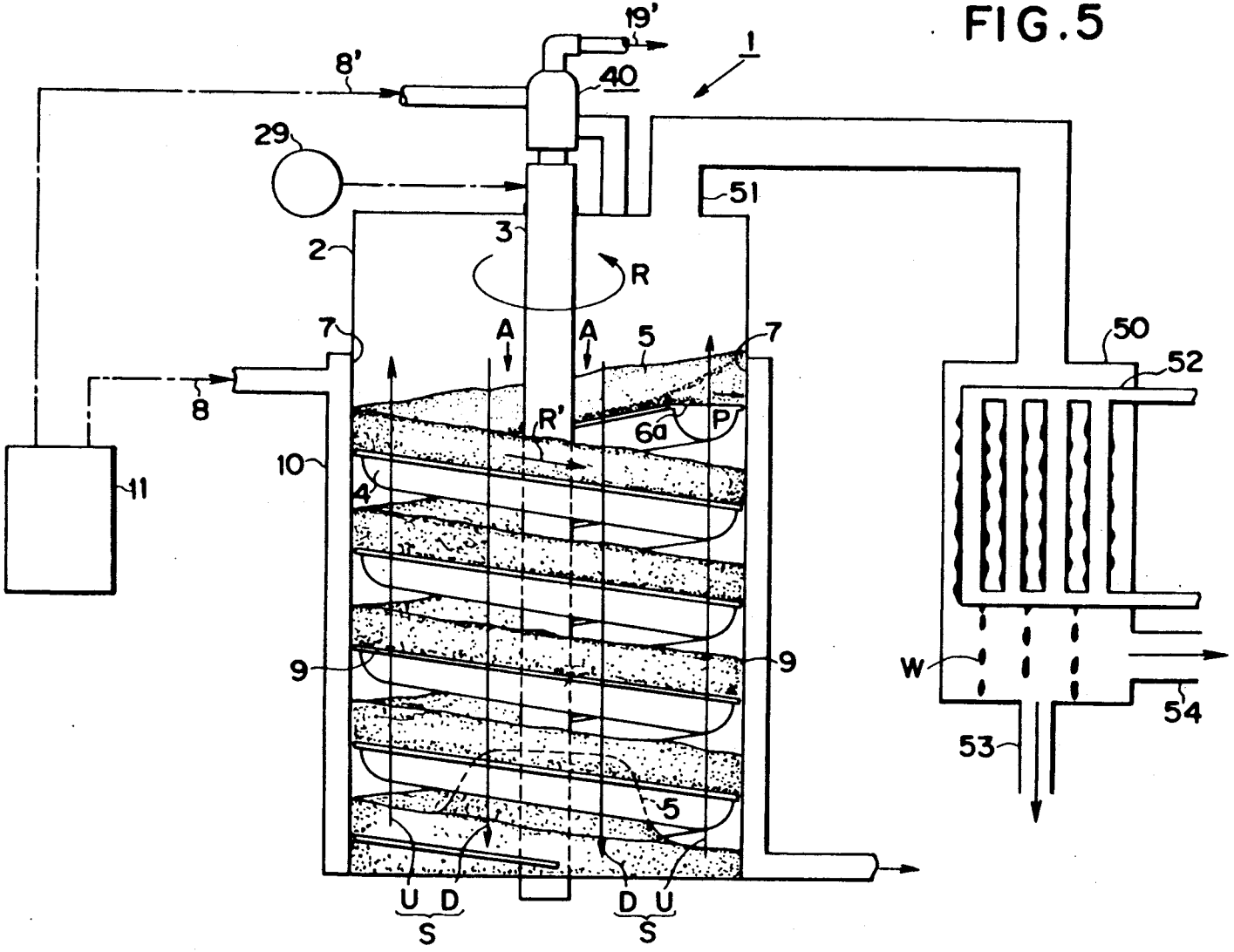
FIG. 5 is a diagram of the drying apparatus and associated boiler and condenser.

The drying vessel 2 has a vapor duct 51 connected to an associated condensor 50. The water when removed from the wet substance, will be changed to vapor. The resultant vapor will be allowed to leave the drying vessel 2 through the vapor duct 51. In FIG. 1 the vapor duct 51 is omitted for clarification of the drawing. The cooling unit 52 of the condensor 50 will cool the vapor for condensation. As seen from FIG. 5, the condensor housing has a drain 53 and a gas outlet 54. The drain 53 permits the drawing-off of water W upon condensation of vapor, and the gas outlet 54 permits the discharging of the gas other than vapor. The drying vessel 2 has means to circulate wet substance therein. The structure described so far is found in conventional drying apparatus. As described earlier, the conventional drying apparatus has a cylindrical drying vessel positioned horizontally, or perpendicular to the direction of gravity.

In contrast, the drying vessel 2 has a vertical spiral blade 4 fixed to a rotary axle 3 for circulating wet substance. The cylindrical vessel 2 stands upright on its legs 22 on the ground g.

The rotary axle 3 extends on the center line of the cylindrical vessel 2. The bottom end 23 of the rotary axle 3 is inserted in a counter sunk hole 24 on the bottom floor of the drying vessel 2 with a thrust washer 25 intervening between the bottom end of the rotary axle 3 and the bottom floor of the drying vessel 2. The top end length 26 of the rotary axle 3 passes through a hole 27 of the ceiling of the drying vessel 2 to appear out of the top plate of the drying vessel 2. The top end length 26 of the rotary axle 3 is rotatably fixed to the ceiling of the drying vessel 2 by a bearing 28. A motor 29 is used to rotate the rotary axle 3. The motor 29 is fixed to the vessel 2 by attachment piece 30. The drive shaft 31 of the motor 29 is connected to the pulley 32 of the rotary axle 3 by a drive belt 33.

In this particular example the rotary axle 3 is a hollow tube with a siphon drain tube 34 extending therein. The lower end 35 of the siphon drain tube 34 is put in the counter sunk hole 37 of the bottom stopper 36, reaching short of the bottom of the counter sunk hole 37. The upper end length 26 of the siphon drain tube 34 passes through the hollow upper length 39 of the rotary axle 3 to appear from the top end of the rotary axle 3. The upper end length 26 of the rotary axle 3 is connected to the rotary joint portion 41 of a locky joint 40. The upper end length of the siphon drain tube 34 is connected to the joint 40. A steam conduit 17' extends from the boiler 11 to the joint 40, and a drain conduit 20' is connected to the joint 40 via a coupler 42. Thus, steam 8' flows into the hollow space of the rotary axle 3 through the steam conduit 17' and the channel of the upper end length 39 of the rotary axle 3. On the other hand, water 19' rises through the siphon drain tube 34 to enter the conduit 20'. The joint 40 is fixed to the vessel body 2 by attachment piece 55.

The vertical, rotatable, spiral blade 4 is composed of a hollow tube whose cross section is semicircular. The spiral blade 4 is fixed to the rotary axle 3 by a plurality of arms 43 with its flat surface 6*a* up. The lower blade portion 44 is rectangular in section. The spiral blade 4 has partition walls 47 at its upper and lower ends and at two intervenient locations. Thus, the spiral hollow space is divided into three compartments. The arms 43 are tubes, each communicating the hollow space of the rotary axles 3 with the compartments of the spiral blade 4. Specifically, a steam inlet arm 43*a* is attached to the upper part of each compartment, and a drain arm 43*b* is attached to the lower part of the compartment. The rotary blade 4 is close to the inner wall of the drying vessel 2, still leaving a gap therebetween, thereby permitting rotation of the spiral blade 4. The inside of the spiral blade around the rotary axle 3 provides a substance falling space A in the drying vessel 2.

The drying vessel 2, rotary axle 3 and rotary blade 4 are made up by welding several associated parts although they are shown as integral unit for the sake of simplicity of drawings.

In operation, first the closure 13 is opened to throw wet substance 5 such as bean-curd refuse in the drying vessel 2.

The water content of this wet substance is about 95% by weight. Therefore, the wet substance is so heavy that it is inconvenient to transfer it before dewatering. Also, disadvantageously it will be easily corrupted if it is allowed to contain much water.

Figure 2:
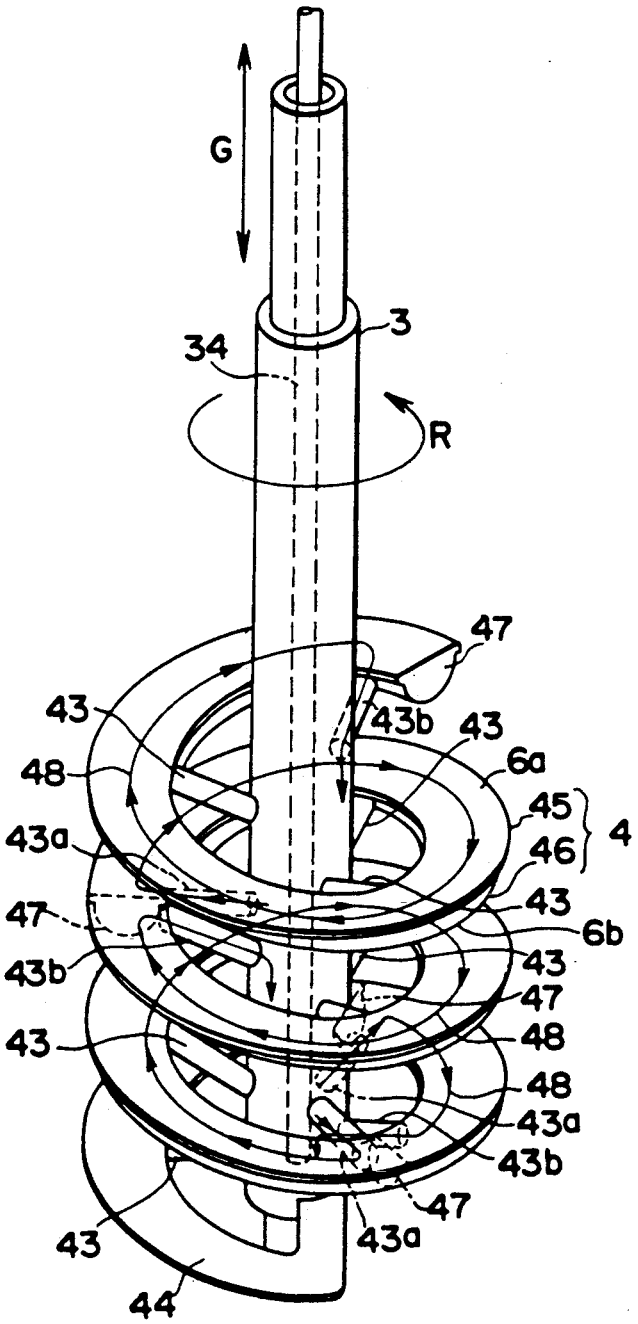
FIG. 2 is a perspective view of a rotary spiral blade.
Figure 3:
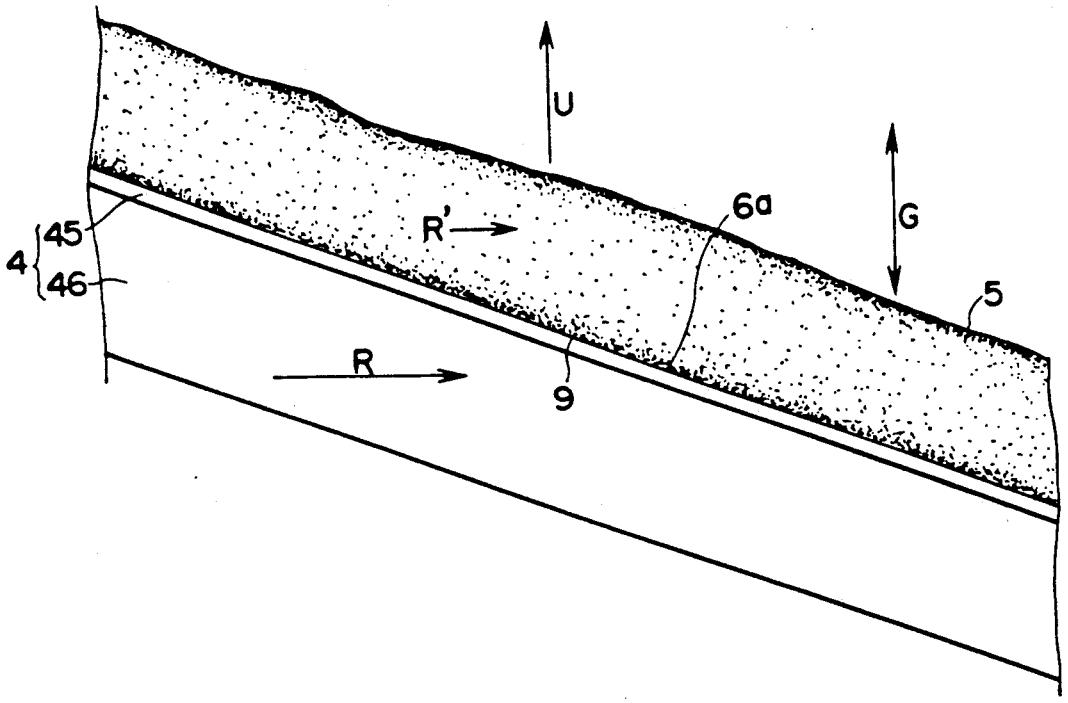
FIG. 3 is a side view of the rotary spiral blade, showing how the wet substance is raised.
Figure 4:
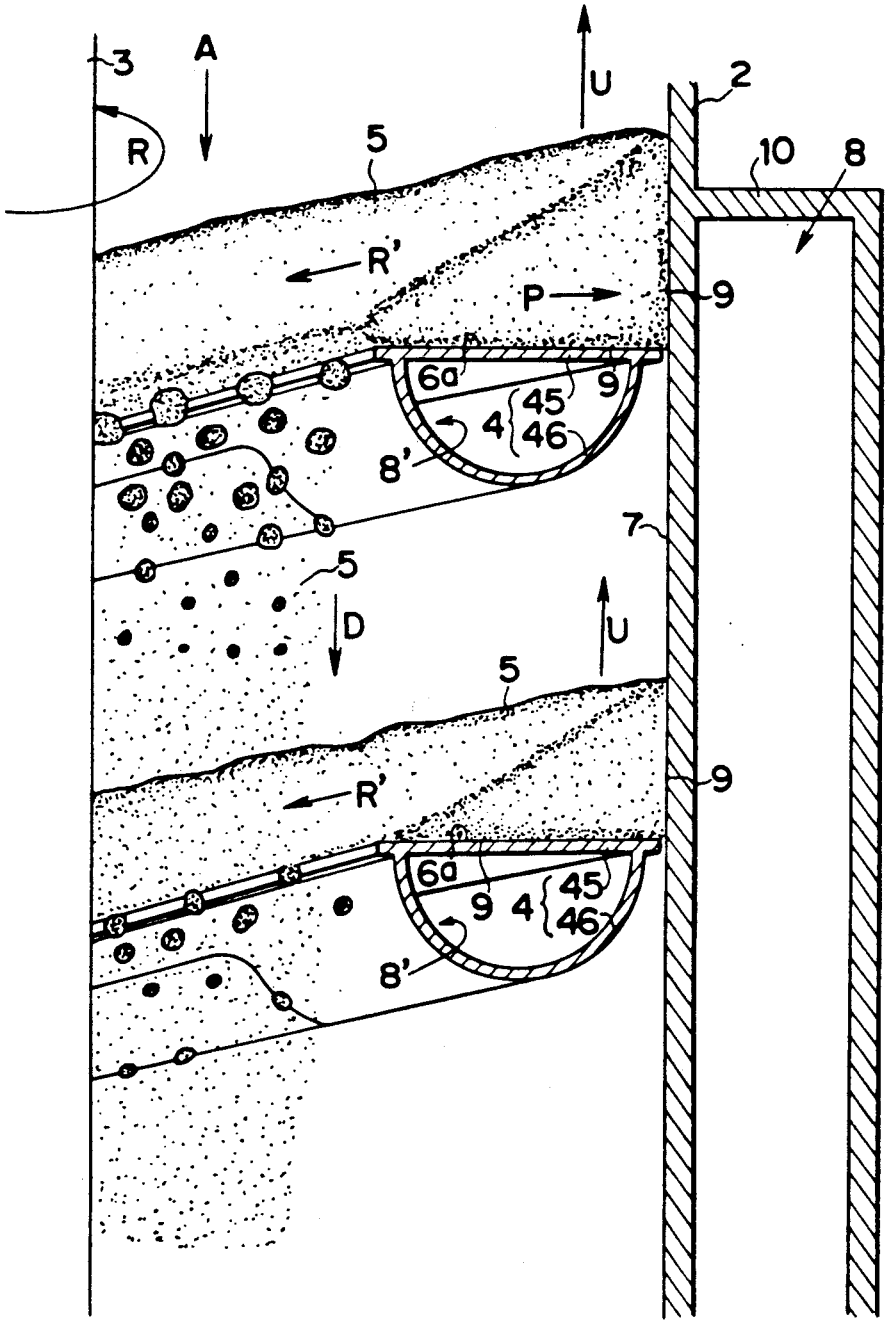
FIG. 4 is a longitudinal section of the spiral blade and the drying vessel, showing how the substance is made to rise and fall.

The bean-curd refuse 5 will be distributed in the drying vessel 2 in the direction of gravity. Steam 8 is supplied from the boiler 11 to the jacket 10 of the drying vessel 2 to heat the inner wall of the drying vessel 2 and at the same time, steam 8' is supplied to the hollow space of the rotary axle 3 via the joint 40, thus flowing in the inner space of the spiral blade 4 via its arm 43*a*. Then, the blade 4 is heated to provided a heat conduction surface 6*a* on its upper flat panel 6*a* . After heating the heat conduction surface 6*a* the steam 8' will be condensed and drained from the inner space of the blade 4 to the inner space of the rotary axle 3 via the drain arm 43*b* until the water is collected in the recess 37 of the bottom of the rotary axle 3. The steam pressure within the hollow space of the rotary axle 3 will cause the water to rise in the siphon tube 34 until it will be drained through the joint 40 as indicated by arrow 19' in FIG. 1. The motor 26 is put in operation to rotate the rotary blade 4 counter clockwise as indicated by arrow R. FIG. 2 is a perspective view of an assembly of rotary axle 3 (containing a siphone tube 34) and rotary blade 4. Steam 8' and condensed 19' flow as in dicated by arrow 48. Rotation of the spiral blade 4 will cause the wet substance to rise upwards. Rising of the wet substance 5 will be described with reference to FIG. 3. In FIG. 3 the drying vessel 2 and the rotary axle 3 are omitted for the clearity of the drawing. Assume that the rotary blade 4 is rotated. The wet substance 5 which is laid on the blade surface 4, will retain its state of rest under the influence of inertia. As a consequence the overlying substance 5 is caused to slidingly climb on the flat heat conduction surface 6*a* of the spiral blade 4. While climbing on the heat conduction surface of the spiral blade, the wet substance will be dewatered effectively because the part 9 of overlying wet substance 5 in contact with the heat conduction surface 6*a* will be renewed all the time. Because of the friction between the overlying substance 5 and the heat conduction surface 45 of the blade the overlying substance 5 will be rotated at a speed which is somewhat lower than the rotary speed of the spiral blade 4, as indicated by arrow R' in FIG. 3. Rotation of the overlying substance 5 will cause application of a centrifugal force P to the overlying substance, thereby moving and pushing it against the inner wall 7 of the drying vessel 2. Thus, the substance 5 will be raised while being pushed against the heat conduction surface 7 of the drying vessel 2. This will expedite dewatering. The amount of substance on the spiral blade 4 will increase with the increasing level in the drying vessel 2 until it overflows the spiral blade 4 to fall in the inside space A of the spiral blade 4 as indicated by arrow D in FIG. 4. Rising U and falling D of the whole substance 5 will be effected in the drying vessel 2 all the time, thereby putting the substance in vigorous circulation. Circulation S of the substance 5 in the drying vessel 2 will increase the efficiency with which the substances 5 is brought in contact with the heat conduction surface of the drying apparatus. Circulation of the substance, and hence the drying efficiency of the drying apparatus can be increased by increasing rotation per unit time of the spiral blade 4.

It is noted that, as the spiral blade 4 drives the wet substance 5 against heat conduction surface 4, the wet substance develops thin film of evaporating water on the heat conduction surface 7. Thus, heating surface area of the wet substance becomes nearly equal to the evaporation area. This maintains high drying efficiency of the wet substance.

The sliding of the substance 5 on the rotary blade 4 has an effect of substantially reducing the resistance against which the blade 4 is rotated, and therefore the blade 4 does not require an increased strength which otherwise, would be required. Accordingly, the weight of the rotary blade 4 can be reduced, and hence the strength and hence weight of the rotary axle 3 to support the rotary blade 4 can be reduced. Thus, the total weight of the rotary blade-and-axle assembly is reduced, and accordingly rotation per unit time of the rotary assembly can be increased for a given power motor. Otherwise, a motor of less power may be used to rotate the rotary assembly at a desired rotation per unit time. This is advantageous from the economical point of view.

By increasing the rotation per unit time of the rotary blade 4 the wet substance 5 such as cornstarch, bean-curd refuse or water-and-powder mixture can be put in vigorous circulation in the drying vessel 2, and accordingly the substance can be brought into contact with the heat conduction surface 6*a* and 7 both of the rotary blade and the inner wall of the drying vessel at such an increased efficiency that water may be removed from the wet substance effectively.

In the particular embodiment described above the blade is shown as being supplied with steam for heating, but this should be understood as optional. Boiled water may be used in place of steam.

As may be understood from the above, the use of rotary spiral blade standing upright in a drying vessel permits vigorous circulation of substance to be dried, thereby bringing the substance into contact with the heat conduction surface of the drying apparatus at such an increased efficiency that water may be removed from the substance most effectively. The increase of rotation of the rotary blade will expedite the dewatering of the wet substance. The substance is liable to slide on the inclined upper surface of the blade, and therefore the resistance against which the blade is rotated, is substantially reduced. This permits increase of rotation per unit time of the rotary blade for a given power motor; reduces substantially the possibility of the blade being damaged; and permits substantial reduction of strength of the blade, and hence weight of the blade.

Rotation of the rotary blade will cause the overlying substance to be pushed against the inner wall of the drying vessel under the centrifugal force, thereby increasing the efficiency with which the substance is brought into contact with the heat conduction surface of the drying vessel.

I claim:

1. A drying apparatus for removing water from a liquid, semisolid or solid substance to be dried, comprising:

a drying vessel to contain said substance, said vessel having a heat conduction surface on its inner wall for transmitting heat to said substance; and circulating rotary means for moving said substance within said vessel, thereby increasing the efficiency with which said substance can be brought into contact with said heat conduction surface, said circulating rotary means including:

a rotary shaft vertically extending in said vessel in the direction of gravity, and a spiral blade integrally connected to and wound around said rotary shaft, said spiral blade having a flat upper surface, a hollow space within, and means for permitting heating medium to flow inside the hollow space of said spiral blade, whereby rotation of said rotary shaft and hence said spiral blade may cause said substance to rise up in the direction of gravity while sliding on said flat upper surface of said spiral blade until the raised substance is allowed to fall down in the direction of gravity through falling space in said drying vessel, and said substance may come in contact with said heat conduction surface while being circulated in said drying vessel.

2. An apparatus for removing water from a substance, comprising:

a vessel for containing the substance, the vessel having a heating wall capable of transferring heat from a heating medium to the substance; and means for moving the substance inside the vessel, including a rotary shaft vertically extending inside the vessel, and a spiral blade of a given length connected to and wound around the rotary shaft, for transporting the substance near the bottom of the vessel to near the top of the vessel, the spiral blade having a flat upper surface and having an outer edge forming a gap with the heating wall.

3. An apparatus as in claim 2, wherein the vessel is a cylinder, the cylinder being coaxial with the rotary shaft.

4. An apparatus as in claim 2, wherein the spiral blade comprises a hollow body, the hollow body providing paths for said heating medium to flow therethrough.

5. An apparatus as in claim 4, wherein the hollow body comprises partitioning walls.

* * * * *